United States Patent [19]

Sobbe

[11] 4,218,064

[45] Aug. 19, 1980

[54] AERIAL BOMB SIMULATING DEVICE FOR MODEL AIRCRAFT

[76] Inventor: Donald A. Sobbe, 9641 S. Avers, Evergreen Park, Ill. 60642

[21] Appl. No.: 5,686

[22] Filed: Jan. 23, 1979

[51] Int. Cl.[3] ..... A63B 71/02; F42B 25/18

[52] U.S. Cl. ..... 273/428; 273/418

[58] Field of Search ..... 273/106 R, 106 E, 105.4, 273/95 R, 95 B; 102/7.6, 92.7, 6; 46/200

[56] References Cited

U.S. PATENT DOCUMENTS

| | | | |
|---|---|---|---|
| 2,338,719 | 1/1944 | Holt | 102/7.6 |
| 3,176,944 | 4/1965 | De Ferdinando | 273/105.4 |
| 3,225,490 | 12/1965 | Ostrom | 46/200 |
| 3,382,800 | 5/1968 | Biggs, Jr. | 102/6 |
| 3,498,218 | 3/1970 | Myers | 102/6 |

FOREIGN PATENT DOCUMENTS

| | | | |
|---|---|---|---|
| 420291 | 4/1947 | Italy | 273/106 E |

*Primary Examiner*—Paul E. Shapiro

*Attorney, Agent, or Firm*—Richard A. Zachar

[57] ABSTRACT

An aerial bomb simulating device for model aircraft includes a pair of interlocking sections. A combination lap joint and snap-in finger interlock arrangement affords bomb integrity upon incidence of G-loading and enables break-apart capability of the bomb upon impact.

1 Claim, 4 Drawing Figures

FIG. 1
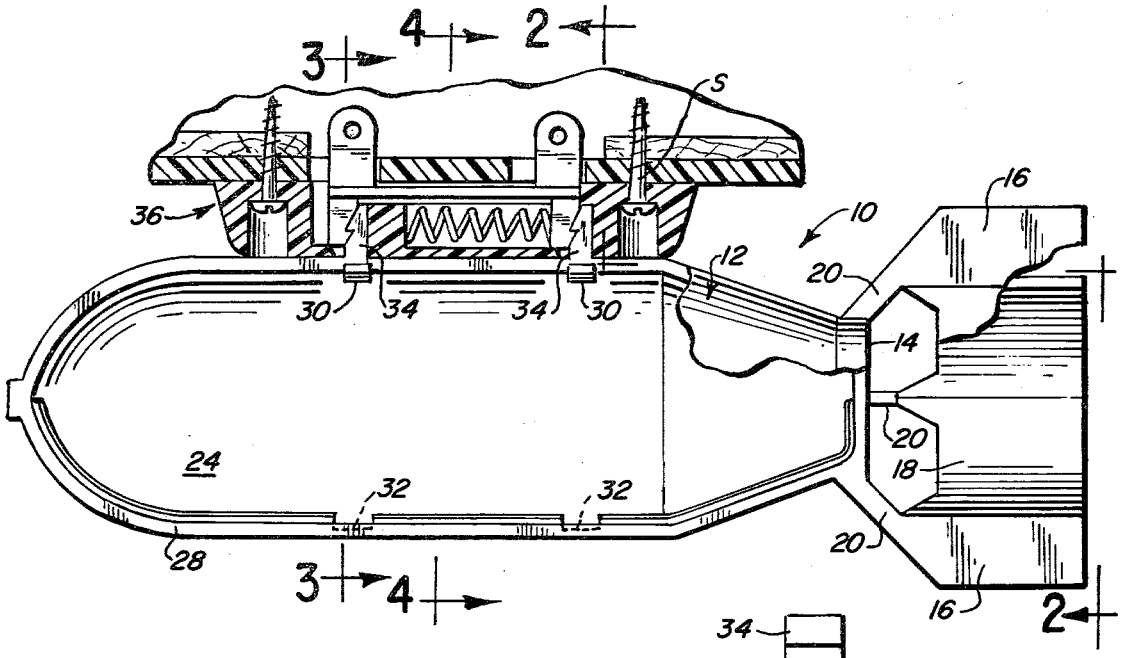
FIG. 3
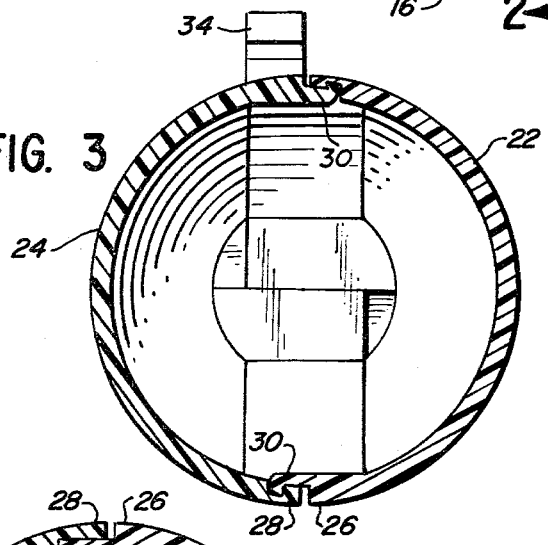
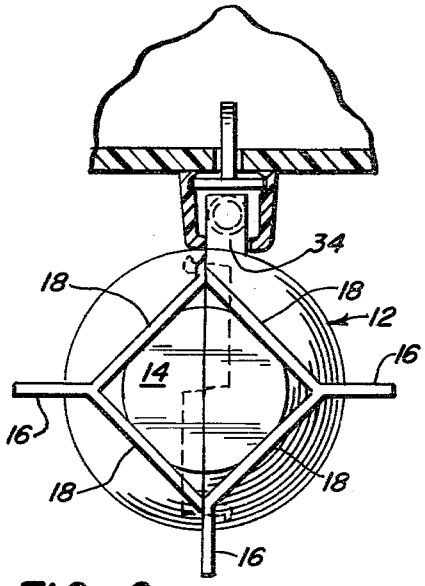
FIG. 2
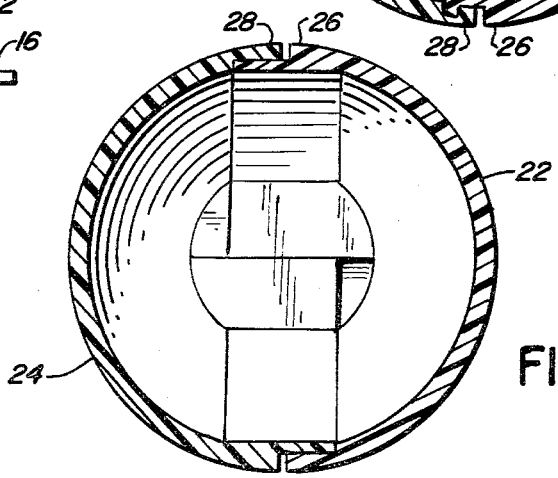
FIG. 4

AERIAL BOMB SIMULATING DEVICE FOR MODEL AIRCRAFT

BACKGROUND OF THE INVENTION

The present invention relates to the art of model aircraft and accessories and, particularly, relates to a re-usable aerial bomb simulating device.

Prior to the present invention, model aircraft bombs were generally of a homemade variety, falling into one of the following two types. A first class include those of the static variety. That is, after they are dropped from the model aircraft, they merely impact the ground. Although these devices are for the most part re-usable, they do not afford the capability of simulating an explosion on impact. They are generally made from rigid material such as wood and because of this rigidity such devices are not generally considered safe (as the term applies to energy dissipation). A second class include those devices which use a tissue or light paper cylinder that is filled with a fine inert powder such as flour, corn starch, etc. These devices are dropped from aircraft and burst on impact with the ground, discharging the powder into a cloud of smoke. While this effectively simulates an explosion, the bomb is destroyed on impact and is not re-usable.

SUMMARY OF THE INVENTION

An object of the present invention is to provide a re-usable model aircraft bomb capable of breaking apart upon impact with the ground to permit discharge of powder to thereby simulate an explosion. A more particular object is to provide in a re-usable model aircraft bomb a means of interlocking two bomb body forming sections to maintain the integrity of the bomb configuration notwithstanding positive and negative G-loads, while at the same time affording break-apart capability of the bomb on impact.

A re-usable aerial bomb simulating device in accordance with the present invention includes a hollow break-apart main body portion, which may be filled with powder to be dispersed upon impact in a cloud of smoke after the device has been dropped from a model aircraft suitably equipped with a bomb carriage and release mechanism. Specifically, the present invention provides an improvement wherein the bomb body portion comprises first and second engageable body forming halves having matingly engagable circumambient edge regions. One of the sections is provided with means for forming a pair of shackles adjacent an edge region portion thereof for releasable engagement with the bomb carriage and release mechanism, whereby only one of the two sections is directly supported from the model aircraft. The edge regions of the two sections include portions which provide a circumambient lap joint when the edge regions are in mating engagement. Spaced snap-in fingers are further provided along the edge regions. The combination of snap-in fingers and lap joint provide full support for the section of the bomb that does not include the shackles, and affords bomb shape integrity against positive and negative G-loading.

Other features and advantages of the invention will be apparent from the following description and claims and are illustrated in the accompanying drawings which show structure embodying preferred features of the present invention and the principles thereof, and what is now considered to be the best mode in which to apply these principles.

BRIEF DESCRIPTION OF THE DRAWINGS

In the accompanying drawings forming apart of the specification and which in like numerals are employed to designate like parts throughout the same:

FIG. 1 is a side elevational view, with portions broken away, showing the bomb simulating device of the present invention shackled to a suitable model aircraft bomb carriage and release mechanism;

FIG. 2 is a view, partially in section, taken as indicated on the lines 2—2 of FIG. 1;

FIG. 3 is a sectional view taken, as indicated, along the line 3—3 of FIG. 1 showing the snap-in interlock connection of the two sections of the bomb simulating device; and FIG. 4 is a sectional view taken, as indicated, along the line 4—4 of FIG. 1 showing the lap joint interlock connection with the two sections of the bomb simulating device.

DETAILED DESCRIPTION

Referring now to the drawing and particularly to FIG. 1, the principles of the present invention, for purposes of illustrative disclosure, are shwon embodied in a replica of an American type 500 pound bomb of a type used during the Second World War. The bomb includes a main body 12 of generally cylindrical shape, the front of which is in the form of a parabolic hemisphere forming a round nose. The rear of the body 12 abruptly tapers to a flat rear end 14 that is approximately one-half the diameter of the main cylindrical portion of the body 12. Cruciform shaped fins 16 at the rear provide lateral stability during free fall. The fins 16 are supported by a polygon shaped gusset 18 and the fins 16 are connected to the body 12 by short rectangular shaped extensions 20 of the leading edges of the fins. Preferably, the entire bomb structure is formd by an injection molding process from low density polyethylene.

In the embodiment disclosed herein, the bomb simulating device comprises substantially two identical section halves 22, 24 having matingly engagable circumambient edge regions 26, 28. As indicated, the parting line for each section half includes a simple butt joint extending the length of one edge portion thereof and a simple lap joint extending the length of its opposite edge. Thus, when the two section halves 22, 24 of the device are matingly engaged, a continuous lap joint is established fully around the lengthwise corcumference of the bomb body. This lap joint provides (1) self-alignment of the two section halves, (2) a seal which prevents leakage of the pay load (i.e., powder) and, (3) a reinforcement for, and integral part of, the interlock that holds the two section halves together, as will be described more fully hereinafter.

Each of the body sections 22, 24 is provided with two latches or snap-in fingers 30 that project outwardly from the side of the edge regions 26, 28 and each of the halves 22, 24 is further provided with two pockets 32 for receiving the snap-in fingers 30 of the opposite section. It will be appreciated that the combination of the lap joints and snap-in fingers interlock create a positive tongue and groove type connection of the sections 22, 24.

One of the two sections, section 24, includes means forming a pair of shackles 34 having saw toothed faces. Shackles 34 releasably engage a suitable spring-loaded bomb carriage and release mechanism 36 shown attached to the model aircraft by a pair of screws S. It will be noted that shackles 34 support the weight of the bomb simulating device 10. However, only one of the two sections 22, 24 is directly supported. The other section is supported entirely by the four snap-in fingers 30. When the device 10 is subjected to positive G-loads, the snap-in fingers 30 tend to reinforce their gripping engagement with the pockets 32. Negative G-loads are absorbed by the lap joints, which in turn, tend to prevent the snap-in fingers from disengaging from their respective receiving pockets. The combination of the lap joint interlock and snap-in finger interlock disclosed herein does not require or depend on any flexing or spring action of the material comprising the two sections and enables the bomb device to maintain its integrity notwithstanding the effect of positive and/or negative G-loading.

It has been found that in order for the lap joint snap-in finger interlock arrangement to open upon impact, the two sections of the device 10 must be constructed of a tough and flexible material, such as a light-to-medium density polyethylene or polypropylene.

The device disclosed herein is designed to impace the ground nose first. However, separation will occur over wide range of angles and positions at impact. The velocity and foot-pounds necessary to cause distortion of the parts for separation varies with the flexibility of the material used in the structure.

Separation occurs in the following manner (regardless of whether the interior of the body 12 is empty or filled with a pay load). At impact, distortion of the edge regions (i.e., at the parting line between the two sections 22, 24) causes the lap joints to push out and away from its opposite half. This action causes misalignment of the snap-in fingers enabling them to pop free from their respective pockets. The two halves, being free from each other, enable the pay load to be discharged. The discharge of the pay load is further enhanced by the two bomb sections returning to their original shape. This flexing of the material, constituting the two section halves, also tends to absorb rather than impart energy at impact, thereby making the device relatively harmless.

While the preferred constructional features of the invention are embodied in the structure illustrated herein, it is to be understood that changes and variations may be made by those skilled in the art without departing from the spirit and scope of the appended claim.

What is claimed is:

1. In a re-usable aerial bomb simulating device having a hollow, break-apart main body portion fillable with powder for dispersal in a cloud upon impact of the device after having been dropped from a model aircraft equipped with a bomb carriage and release mechanism, the improvement wherein said body portion comprises first and second interengagable body forming sections having matingly engageable circumambient edge regions, one of said sections having means defining a pair of shackles adjacent the edge region portion thereof for releasable engagement with the bomb carriage and release mechanism whereby only said one of said sections if directly supported thereby, means along said edge regions for providing a circumambient lap joint when said edge regions are in mating engagement, and a plurality of snap-in fingers integral of said edge regions engageable with corresponding recess areas of the opposing section for jointly with said lap joint affording interlock connection of said sections.

* * * * *